United States Patent [19]

Pearson

[11] 4,163,665

[45] Aug. 7, 1979

[54] ALUMINUM ALLOY CONTAINING MANGANESE AND COPPER AND PRODUCTS MADE THEREFROM

[75] Inventor: Kenneth R. Pearson, Riverside, Calif.

[73] Assignee: Alumax Mill Products, Inc., Riverside, Calif.

[21] Appl. No.: 916,943

[22] Filed: Jun. 19, 1978

[51] Int. Cl.[2] ..... C22F 1/04

[52] U.S. Cl. ..... 75/143; 75/141; 148/11.5 A

[58] Field of Search ..... 75/138, 141, 139, 143; 148/11.5 A, 2, 32

[56] References Cited

U.S. PATENT DOCUMENTS

| | | | |
|---|---|---|---|
| 2,790,216 | 4/1957 | Hunter | 22/57.5 |
| 3,341,368 | 9/1967 | Chevigny et al. | 148/2 |
| 3,392,062 | 7/1968 | Altenpohl et al. | 148/11.5 |
| 3,793,089 | 2/1974 | Dorward et al. | 148/2 |
| 3,818,566 | 6/1974 | Anderson et al. | 29/195 |
| 3,945,860 | 3/1976 | Winter et al. | 148/11.5 |
| 4,000,009 | 12/1976 | Chatfield | 148/2 |
| 4,017,337 | 4/1977 | Winter et al. | 148/11.5 |
| 4,028,141 | 6/1977 | Chia et al. | 148/2 |
| 4,093,475 | 6/1978 | Manzonelli et al. | 148/32 |

*Primary Examiner*—L. Dewayne Rutledge
*Assistant Examiner*—Upendra Roy
*Attorney, Agent, or Firm*—Knobbe, Martens, Olson, Hubbard & Bear

[57] ABSTRACT

A new alloy of aluminum is disclosed which consists essentially of residual silicon up to 0.60 percent, residual iron up to 0.70 percent, residual zinc up to 0.30 percent, 0.05 to 0.20 percent copper, 0.40 to 0.90 percent manganese, and balance essentially aluminum. The properties of the alloy are especially conducive to producing sheet metal stock cast by continuous methods and have a general wide-ranging utility for forming many products, heretofore unobtainable from a continuous casting method.

2 Claims, No Drawings

ALUMINUM ALLOY CONTAINING MANGANESE AND COPPER AND PRODUCTS MADE THEREFROM

BACKGROUND OF THE INVENTION

The present invention broadly relates to a new aluminum alloy having a specified range of manganese which is especially significant in making the alloy conductive to being continuously cast into sheet metal stock and the method of preparation of such sheet metal stock.

Aluminum alloy sheet metal stock is widely used in the manufacture of closures, such as bottle lids; containers, such as beverage cans; air conditioning ducts, such as a spiral duct; and heat transfer fins, such as fin stock. In order to produce such products, the thickness of the thin gauge aluminum sheet must be about 0.10 millimeters to 0.27 millimeters to conserve metallic aluminum and thereby reduce material costs. At such thin gauges, it is essential that the sheet metal stock have relatively high tensile and yield strength so that the products produced will be sufficiently strong. The sheet metal stock must also be ductile and readily formable.

Before the present invention, the aluminum alloy most commonly used to produce such sheet metal stock met the specifications of the American Society For Metals (A.S.M.) aluminum alloy specification 3003. This alloy contains 1.0 to 1.5 percent manganese. Other constituents include 0.6 percent silicon, 0.7 percent iron, 0.05 to 0.20 percent copper, and 0.3 percent zinc with the remainder aluminum. The 3003 specification aluminum alloy can be cast by conventional hot mill processes and formed into desired products, such as beverage containers. However, it has heretofore been impossible to use an alloy conforming to a specification such as 3003, in a continuous casting process to produce the desired aluminum sheet metal stock.

The first teaching of the continuous casting of aluminum alloys was described in U.S. Pat. No. 2,790,216, issued to J. L. Hunter. Today many variations on the Hunter continuous process exist. The continuous casting of metal is preferred over the more conventional methods, referred to in the aluminum industry as D.C. or direct chill, because the water cooled rolls of the continuous casting method increase the metal solidification rate. This more rapid solidification rate, obtainable with continuous methods, produces several desirable metallurgical characteristics. The primary advantage is the development of a desirable constituent particle population. The distribution of the particles is much greater and their size is much smaller than is possible with material produced at solidification rates experienced with direct chill methods. This difference in distribution can be readily seen in the microstructure when comparing direct chill with continuous processes. Importantly, the same degree of fineness and greater distribution cannot be obtained with sheet produced by direct chill as with the continuous casting process. When casting aluminum alloys containing manganese, aluminum-manganese compounds, such as MNAL6 and ALMNSI, predominate as constituents. When alloys containing percentages of manganese of 1.0 to 1.8 percent are attempted to be continuously cast into sheet metal stock for products, such as containers, the resulting cast stock possesses an excessive amount, size, an distribution of manganese-base constituent. In other words, the resulting cast stock is too hard to cold work into an acceptable sheet metal stock.

The present invention provides a manganese-aluminum alloy which is especially conducive to being continuously cast and subsequently cold worked into sheet metal stock for products. The new alloy therefore provides an optimum distribution of inter-metallic manganese based constituents required by continuous casting that was not present in those alloys utilized in the direct chill methods. As a result, the drawing and forming characteristics of the continuously cast stock from this alloy are dramatically and strikingly improved over any alloys heretofore used in the continuous cast method. In fact, products which could not previously be produced from sheet stock of continuous origin can now be readily fabricated. This represents a significant contribution to the technology of producing generalized products using continuous methods. It is expected that conversion of many existing products to this alloy will lend to noticeable improvements in fabrication results, improved quality levels, and reduced production costs. The alloy should lend itself to many heretofore unexpected or unrecognized applications.

SUMMARY OF THE INVENTION

An aluminum alloy composition of improved draw ability and formability is disclosed which consists essentially of residual silicon up to 0.60 percent, residual iron up to 0.70 percent, residual zinc up to 0.30 percent, 0.05 to 0.20 percent copper, 0.40 to 0.90 percent manganese, and balance essentially aluminum. The alloy possesses excellent properties for producing sheet metal stock from continuous casting methods. Secondly, a method of preparing aluminum alloy sheet metal stock is disclosed comprising the steps of continuously casting the aluminum alloy, disclosed above, homogenizing said alloy casting by heating, cold rolling said homogenized alloy to the desired gauge with intermediate anneals, where necessary, to produce a cold rolled sheet metal product.

DESCRIPTION OF THE PREFERRED EMBODIMENT

The manganese-aluminum alloy in the continuously cast manganese-aluminum alloy castings of the present invention consist essentially of residual silicon up to 0.60 percent, residual iron up to 0.70 percent, residual zinc up to 0.30 percent, 0.05 to 0.20 percent copper, 0.40 to 0.90 manganese, and balance essentially aluminum. The total manganese content of 0.4 to 0.9 percent by weight is particularly adapted to continuous casting methods and is far less than that required for the more conventional direct chill method. Since manganese is more costly than aluminum, the cost to produce the new alloy is less. But primarily, the new composition provides a combination of mechanical and physical properties at final gauge that are unattainable with direct chill casting at the same manganese content or composition. The alloy provides a microstructure which has good drawing and forming characteristics, particularly for products, such as closure stock, beverage cans, fin stock, spiral duct, and the like. In most products, the quality level is equal to if not better than at the higher manganese contents required with direct chill methods. Finally, since the development enables continuous cast stock to compete directly against material of direct chill origin, it enables continuous cast stock to be considered for new applications heretofore not feasible with continuous stock. Products or series of products which were heretofore feasible to produce only through direct chill methods can now be produced by the continuous casting method. This advantage of being able to eliminate the conventional direct chill method is of great importance when the cost of a new installation is considered. A new installation for using direct chill and hot rolling techniques to produce cold mill reroll costs approximately $50,000,000. A similar installation for the continuous casting process to produce cold mill reroll, however, costs only $1,000,000 to $2,000,000. This means that many products can now be produced at a substantially reduced investment.

The alloy is produced from a mixture of recycled aluminum, manganese hardener, and/or virgin metal to provide the resultant composition described above. The aluminum is then melted to a molten state and continuously cast. The various continuous casting methods are well known to those of ordinary skill in the art. One of the first and best-known examples for continuous casting of aluminum alloys was described in U.S. Pat. No. 2,790,216, issued to J. L. Hunter which is incorporated by reference. Generally, continuous casting causes molten aluminum to flow between a pair of water-cooled rotating rolls and solidify into a flat shape. The cast product produced in this manner can be cold rolled directly to an intermediate gauge or can be thermally homogenized and then reduced in thickness by cold rolling. The techniques of cold rolling and homogenization are well known in the art and therefore need not be described in further detail here. Intermediate annealing can be employed where necessary until the desired thickness is obtained. The sheet product at finished gauge can be temper rolled or partial annealed, or full annealed. Again, these processes are well known to those of ordinary skill in the art.

In the preferred embodiment of the method for preparing the aluminum alloy sheet metal, the sheet metal stock is homogenized by heating to a temperature of between 500° C. to 300° C. for about 8 to 16 hours. The homogenized sheet metal stock is then cold rolled to a thinner gauge and thereafter annealed at a temperature of between 340° C. and 430° C. for about 2 to 4 hours. The annealed sheet is thereafter cold rolled to a gauge of about 0.10 millimeters to 0.27 millimeters, depending upon the final gauge desired.

The low manganese content of the present invention of 0.4 to 0.9 percent is responsible for a dramatic increase in the casting speed attainable in continuous casting methods. For example, higher manganese alloys of 1.1 percent to 1.8 percent have a casting speed of between 66 to 76 centimeters per minute. The alloy of the present invention increases the casting speed by 5 to 8 centimeters per minute. In addition, a reduced amount of oxide film occurs during homogenization of the new alloy. This improves quality levels and rolling efficiency.

The following example is set forth in order to clearly point out the detailed description of the invention, but is not intended as a limitation to the same.

EXAMPLE 1

An alloy is produced which contains the following composition: 0.15 percent silicon, 0.60 percent iron, 0.10 percent copper, 0.7 percent manganese, 0.05 percent zinc, and the balance essentially aluminum. A molten bath of the foregoing composition is prepared at a temperature of about 760° C. The molten aluminum is then continuously cast between water cooled rolls to produce continuous cast sheet metal stock having a thickness of about 6.3 millimeters and a width of approximately 0.80 centimeters.

The coiled sheet metal stock is homogenized by heating to a temperature of between 500° C. to 570° C. for about 8 to 16 hours.

The homogenization process produces a sheet metal stock with a thickness of about ¼ inch.

The ¼ inch homogenized sheet metal stock is then cold rolled to a gauge of about 0.27 millimeters and thereafter annealed at a temperature of 413° C. for 2 hours. The annealed sheet is then cold rolled to a gauge of about 0.18 millimeters.

Although the present invention has been described in conjunction with preferred embodiments, it is to be understood that modifications and variations may be resorted to without departing from the spirit of the invention, as those skilled in the art will readily understand. Such modifications are considered to be within the prevue and scope of the invention and the appended claims.

What is claimed is:

1. An aluminum alloy sheet metal stock prepared from a continuously cast aluminum alloy casting consisting essentially of:
   A. Residual silicon up to 0.60 percent;
   B. Residual iron up to 0.70 percent;
   C. Residual zinc up to 0.30 percent;
   D. 0.05 to 0.20 percent copper;
   E. 0.40 to 0.90 percent manganese; and
   F. Balance essentially aluminum
   said casting being homogenized by heating;
   said homogenized alloy being cold rolled to a desired gauge with a plurality of cold rolling passes including first and last cold rolling passes; and
   said cold rolled alloy being annealed at least once intermediate said first and last cold rolling passes.

2. A method of preparing an aluminum alloy sheet metal stock comprising the steps of:
   (a) Continuously casting an aluminum alloy consisting essentially of:
   residual silicon up to 0.60 percent;
   residual iron up to 0.70 percent;
   residual zinc up to 0.30 percent;
   0.05 to 0.20 percent copper;
   0.40 to 0.90 percent manganese; and
   balance essentially aluminum;
   (b) Homogenizing said alloy casting by heating;
   (c) Cold rolling said homogenized alloy to a desired gauge with a plurality of cold rolling passes including first and last cold rolling passes; and
   (d) Annealing said cold rolled alloy at least once intermediate the said first and last cold rolling passes.

* * * * *